United States Patent [19]

Kohn

[11] 4,149,854

[45] Apr. 17, 1979

[54] STABILIZED COAL-OIL SLURRY AND PROCESS

[75] Inventor: Edward M. Kohn, Philadelphia, Pa.

[73] Assignee: Suntech, Inc., Philadelphia, Pa.

[21] Appl. No.: 913,780

[22] Filed: Jun. 8, 1978

[51] Int. Cl.[2] ..... C10L 1/32

[52] U.S. Cl. ..... 44/51

[58] Field of Search ..... 44/51, 7 A; 252/351

[56] References Cited

U.S. PATENT DOCUMENTS

| | | | |
|---|---|---|---|
| 2,118,477 | 5/1938 | Roberts et al. | 44/51 |
| 2,390,609 | 12/1945 | Minich | 44/7 A |
| 2,397,859 | 4/1946 | Hersberger et al. | 44/51 |
| 2,620,312 | 12/1952 | Manzer | 44/51 |
| 2,763,621 | 9/1956 | Shulman | 44/7 A |
| 2,768,138 | 1/1956 | Hotten et al. | 252/37.7 |
| 3,241,505 | 3/1966 | Long et al. | 44/51 |

*Primary Examiner*—Patrick Garvin
*Assistant Examiner*—Y. Harris-Smith
*Attorney, Agent, or Firm*—J. Edward Hess; Donald R. Johnson; Paul Lipsitz

[57] ABSTRACT

Coal-oil slurries are stabilized by incorporation of a mixture comprised of a coal tar or pitch and a grease made from an aluminum based complex soap.

10 Claims, No Drawings

STABILIZED COAL-OIL SLURRY AND PROCESS

It is known in the art to employ a slurry of comminuted coal in oil as a fuel source. Such slurries have essentially the same handling, burning and heating characteristics as fuel oil but they permit reduced oil consumption by the incorporation of the more readily available coal. However, a problem associated with such coal-oil slurries (COS) is that there is a tendency for the coal particles to settle out. Such instability of the COS creates difficulties in transporting it through pipelines and at the point of use.

Numerous disclosures in the prior art recognize this problem and offer various means to solve it. U.S. Pat. No. 1,647,471 suggests the use of a colloidal solution such as a soap solution or a rubber solution to mitigate the problem. U.S. Pat. No. 1,431,225, U.S. Pat. No. 1,733,620 and U.S. Pat. No. 2,668,757 also disclose use of soaps such as ordinary soap or alkaline earth metal (e.g. calcium and magnesium) oleates and stearates. U.S. Pat. No. 3,907,134 employs a mixture of soap and starch for stabilization of coal-oil slurries. In our experience, however, such approaches to the problem are not entirely satisfactory and more effective means for stabilization of coal-oil slurries is required.

We have now found that coal oil slurries can be effectively stabilized against settling of the coal particles by incorporation in the slurry a mixture of a coal tar or pitch and a grease made from an aluminum complex soap.

The coal tar or pitch useful in the invention may be any of the numerous products derived from coal by destructive distillation processes. It is to be understood as is known in the art, that tars are liquid products and pitches are of a more viscous, semi-solid or solid consistency which are obtained as the residue from the distillation of tars. Any of the numerous commercially available tars and pitches are useful in the invention. Typical coal tars are those made by the destructive distillation or carbonization of various coals at temperatures above 450° C. in the absence of oxygen (see "Chemistry of Coal Utilization" vol. II, page 1287, John Wiley & Sons, Inc., 1945 which is incorporated by reference). Typical pitches are those known as roofing pitches, intermediate pitch, target pitch and the like.

Aluminum complex soaps (also known as aluminum di-soaps) and the greases made from them are well known in the art and are disclosed, for example, in U.S. Pat. No. 2,768,138 which is hereby incorporated by reference. These materials are typified by an aluminum-benzoate-stearate complex which is preferred for use in this invention.

In carrying out the invention the tar or pitch product and the grease made from the aluminum complex soap are simply added to the coal-oil slurry. The grease used will be obtained by incorporating about 0.25% by weight of a 1:1 aluminum benzoate-aluminum stearate complex in an oil, as described in U.S. Pat. No. 2,768,138. The amount of grease and tar or pitch together which is added to the coal-oil slurry will be from about 3.5% to about 10% by weight of the slurry, preferably about 5% to about 6% of which the tar or pitch will be from about 60% to 90% by weight (preferably 80 to 85%). A typical composition will comprise a slurry if 20 parts by weight of coal in 30 parts of Bunker C oil to which 2.5 parts of tar or pitch and 0.5 parts of the grease are added.

Preferably the coal tar or pitch and complex grease are added to a heated slurry of the particulate coal in the oil carrier. The resultant slurry is easily handled and is readily pumped through a pipeline and into appropriate burner nozzles for use.

The process of the invention is operable with generally all types of coal and the coal particle size may also vary. In general, however, the best results are obtained when the particle size of the coal is in the micron range and generally the coal will be below about 100 microns.

In order to further illustrate the invention the following examples are given:

Test Procedure:

Settling tubes are made with a transparent, flexible, plastic tubing (I.D. ⅜") by plugging both ends of the tube with short lengths of glass rod (O.D. ⅜"). Each tube is filled first with a 2½" long segment of test slurry before closing off the tube. The test slurry is permitted to settle quiescently in a vertical position overnight in an oven at about 82° C. (about 180° F.). Upon removal from the oven, the sample is allowed to cool and is then chilled with dry ice enabling it to be sectioned into 5 segments each ½" long and cut perpendicular to the direction of sedimentation. The sections are numbered respectively from the bottom section to the top as sections one through five. The tubing is removed from around each segment and the segments are then weighed twice in a wire mesh basket once in air and once in water after permitting the segment to warm to room temperature. The segment's density permits calculation of the percent coal based on the following quantities either measured or calculated:

1. the density of the oil in which the coal is suspended,
2. the density of the uniformly blended coal in oil slurry, and
3. the calculated effective coal density in the slurry.

The coal concentration of each section, when compared with that of the other sections indicate whether or not settlement of the coal occurred. Thus, if all sections have essentially the same coal concentration, no settling occurred and the coal-oil slurry is stable. If however, the coal concentration increases from segment number 5 through segment number 1, it is clear that settlement has occurred.

EXAMPLE I

Coal oil slurries are prepared by dissolving a coal tar or pitch in 25g. of Tetralin at room temperature and 20 grams of Illinois No. 6 bituminous (less than 74μ) are then added and the mixture agitated. Then, 30 g. of an oil having a density of 0.94 or less (Bunker C oil is preferred) and 0.5 g. of the aluminum based complex soap (aluminum benzoate-aluminum stearate complex) are added, heated to 105° C. and mixed well. The Tetralin solvent is then stripped off by distillation.

TABLE

| | Coal Concentration In Each Section Expressed As % wt. Rounded To The Nearest 4% | | | | |
|---|---|---|---|---|---|
| Sample | 1 | 2 | 3 | 4 | 5 |
| A Coal Oil Slurry Alone-Control | 64 | 52 | 48 | 20 | 0 |
| B Coal Oil Slurry with Roofing Pitch (5% wt.) and Aluminum benzoate-Aluminum stearate (1:1) grease (1% by wt.) | 36 | 40 | 40 | 40 | 36 |
| C Coal Oil Slurry with Target Pitch (5% by Wt.) | | | | | |

TABLE-continued

| Sample | Coal Concentration In Each Section Expressed As % wt. Rounded To The Nearest 4% | | | | |
|---|---|---|---|---|---|
| | 1 | 2 | 3 | 4 | 5 |
| and Aluminum benzoate-Aluminum Stearate (1:1) grease (1% by wt.) | 40 | 40 | 40 | 40 | 40 |
| D Coal Oil Slurry with Intermediate Pitch (5% by wt.) and Aluminum benzoate-Aluminum Stearate (1:1) grease (1% by wt.) | 36 | 40 | 44 | 40 | 36 |

As can be seen from Table I only the system of the invention gives a uniformly level concentration under the test conditions and thus the invention provides for a significant means for stabilization of coal slurries.

The invention claimed is:

1. A process for stabilizing a slurry of particulate coal in oil against settling which comprises adding a mixture of a coal tar or pitch and an aluminum based complex soap, the total amount of tar or pitch and complex soap being from about 3.5 to about 10% by weight of the coal slurry of which mixture the coal tar or pitch is from about 60% to 90% by weight.

2. The process of claim 1 where the soap is an aluminum benzoate-aluminum stearate complex.

3. A process for stabilizing a slurry of particulate coal in oil against settling which comprises adding with agitation to said heated coal slurry a mixture of a coal tar or pitch and an aluminum based complex soap, the total amount of tar or pitch and complex soap being from about 3.5 to about 10% by weight of the coal slurry of which mixture the coal tar or pitch is from about 60% to 90% by weight.

4. The process of claim 3 where the soap is an aluminum benzoate-aluminum stearate complex.

5. The process of claim 4 where the stabilizing mixture is a mixture of soap and pitch.

6. A coal oil slurry stabilized against settling comprising particulate coal having a particle size of less than 100 microns suspended in oil and, as a stabilizing agent a mixture of a coal tar or pitch and an aluminum-based complex soap, the total amount tar or pitch and complex soap being present in an amount of from about 3.5% to about 10% by weight of the coal slurry of which mixture the tar or pitch is from about 60% to about 90% by weight.

7. The coal oil slurry of claim 6 where the complex soap is an aluminum-benzoate-aluminum stearate complex.

8. The coal oil slurry of claim 7 where the stabilizing mixture is a mixture of said soap and pitch.

9. The slurry of claim 8 where the pitch is target pitch.

10. The slurry of claim 8 where the pitch is roofing pitch.

* * * * *